US006535087B1

(12) United States Patent
Fitzpatrick et al.

(10) Patent No.: US 6,535,087 B1
(45) Date of Patent: Mar. 18, 2003

(54) MICROWAVE RESONATOR HAVING AN EXTERNAL TEMPERATURE COMPENSATOR

(75) Inventors: William Fitzpatrick, Waterloo (CA); Ming Yu, Waterloo (CA); David Smith, Cambridge (CA); Apu Sivadas, Wellington (CA)

(73) Assignee: COM DEV Limited (CA)

( * ) Notice: Subject to any disclaimer, the term of this patent is extended or adjusted under 35 U.S.C. 154(b) by 0 days.

(21) Appl. No.: 09/650,522

(22) Filed: Aug. 29, 2000

(51) Int. Cl.[7] ..... H01P 1/30; H01P 7/06
(52) U.S. Cl. ..... 333/229; 333/234; 333/202
(58) Field of Search ..... 333/229, 234, 333/202

(56) References Cited

U.S. PATENT DOCUMENTS

| | | | | |
|---|---|---|---|---|
| 2,409,321 A | * | 10/1946 | Stephan | 333/229 |
| 3,936,775 A | | 2/1976 | Snyder | 333/211 |
| 4,677,403 A | | 6/1987 | Kich | 333/229 |
| 4,706,053 A | * | 11/1987 | Giavarini | 333/229 |
| 4,810,984 A | | 3/1989 | Arnold et al. | 333/202 |
| 5,027,090 A | | 6/1991 | Gueble et al. | 333/202 |
| 5,039,966 A | | 8/1991 | Schmid et al. | 333/229 |
| 5,216,388 A | | 6/1993 | Dipoala | 331/96 |
| 5,304,968 A | | 4/1994 | Ohtonen et al. | 333/202 |
| 5,329,255 A | | 7/1994 | Hayes et al. | 331/96 |
| 5,374,911 A | | 12/1994 | Kich et al. | 333/209 |
| 5,589,807 A | | 12/1996 | Tang | 333/212 |
| 5,691,677 A | | 11/1997 | De Maron et al. | 333/219.1 |
| 5,774,030 A | | 6/1998 | Gray | 333/212 |
| 5,818,314 A | | 10/1998 | Baker | 333/226 |
| 5,867,077 A | | 2/1999 | Lundquist | 333/208 |
| 5,905,419 A | | 5/1999 | Lukkarila | 333/202 |
| 6,002,310 A | * | 12/1999 | Kich et al. | 333/208 |
| 6,169,468 B1 | * | 1/2001 | Chavez | 333/229 |
| 6,232,852 B1 | * | 5/2001 | Small et al. | 333/208 |

OTHER PUBLICATIONS

"The Dual–Mode Filter—A Realization", Microwave Journal, vol. 17, No. 12; Dec. 1974, pp 31–33, 63.

* cited by examiner

*Primary Examiner*—Robert Pascal
*Assistant Examiner*—Stephen E. Jones
(74) *Attorney, Agent, or Firm*—Jones Day

(57) ABSTRACT

An externally temperature-compensated microwave resonator comprises a microwave resonator and an external temperature compensator. The microwave resonator is a multi-cavity waveguide. The cavities are configured side-by-side and coupled through irises. The external temperature compensator is oriented and configured to effect a change in volume of the cavities when the resonator and compensator undergo a temperature gradient. The compensator deflects a wall portion of the resonator to accordingly counteract a change in volume of the cavity caused by a temperature gradient.

20 Claims, 3 Drawing Sheets

MICROWAVE RESONATOR HAVING AN EXTERNAL TEMPERATURE COMPENSATOR

BACKGROUND

1. Field of the Invention

This invention relates to the field of microwave filters and resonators.

2. Description of the Related Art

A microwave resonator is an electromagnetic circuit that can be tuned to pass energy at a specified resonant frequency. The resonator can be used in communication applications, either in space or on Earth, as a filter to remove unwanted frequencies from a signal outside of a bandpass frequency range.

The resonator comprises a structure that defines a cavity. The dimensions of the cavity determine the resonant frequency of the resonator. Any change in the dimensions of the cavity will cause a shift of the resonant frequency and a change in the bandpass characteristics of the resonator. Such a change may be caused by expansion or contraction due to thermal stresses, and will adversely affect the resonant frequency and bandwidth. To counteract this thermal effect, resonators typically employ some type of temperature compensating mechanism.

Temperature compensation for microwave resonators is conventionally accomplished by using a material that resists deformation under thermal stresses, such as a bimetallic material that deforms appropriately to temperature changes. Another known technique uses electrical compensators, such as dielectrics, to counteract the thermal effect.

SUMMARY OF THE INVENTION

A microwave resonator is provided that includes an external temperature compensating structure. The external microwave resonator is a cavity with a specified volume. The temperature compensating structure is configured and oriented relative to a wall of the microwave resonator. When the microwave resonator and the temperature compensating structure undergo thermally-induced deflection, the temperature compensating structure applies a restoring force to the wall of the microwave resonator. The applied force deflects the wall oppositely relative to the thermally-induced deflection so as to maintain the volume of the cavity, and thereby maintain the filtering characteristics of the resonator.

Another aspect of the invention provides a microwave resonator having a first body structure and a second body structure. The first body structure has a mating surface and a recess. The recess has a thinned end wall and an inner wall surface. The end wall and the mating surface are perpendicular to the inner wall surface and are located at opposite ends of the recess. The inner wall surface extends around the periphery of the recess and is centered on a central axis.

The second body structure also has a mating surface and a recess. The recess has a thinned end wall and an inner wall surface. The end wall and the mating surface are perpendicular to the inner wall surface and are located at opposite ends of the recess. The inner wall surface extends around the periphery of the recess and is centered on a central axis. The first and second body structures have abutting positions in which the mating surface of the first body structure abuts the mating surface of the second body structure and the central axes align. The recesses together define a cavity. The inner wall surfaces of the first and second body structure are configured to form an electrical continuity in the cavity. Importantly, the electrical continuity is maintained when the end wall of the first body structure is deflected.

DETAILED DESCRIPTION OF THE DRAWINGS

Figure 1:
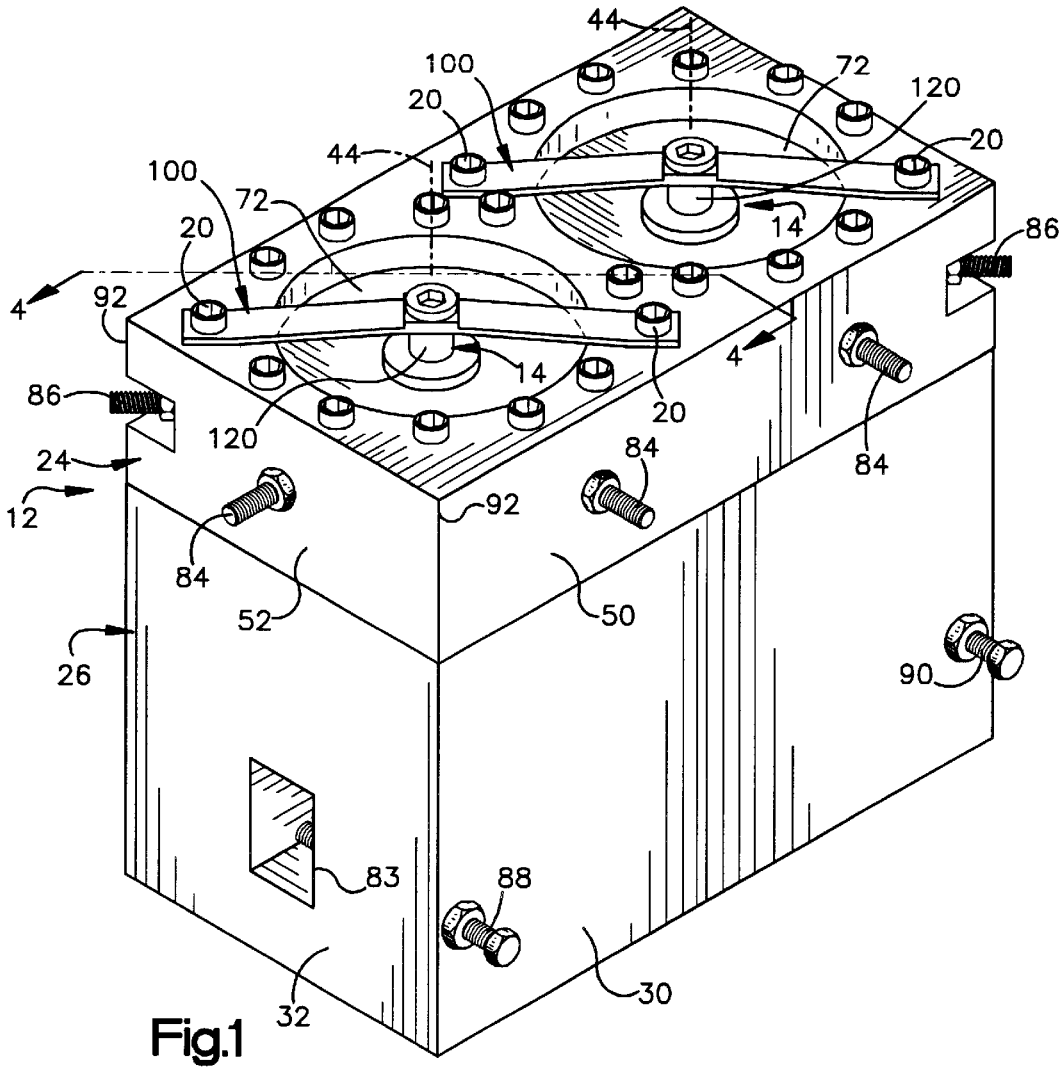
FIG. 1 is an orthogonal view of an apparatus comprising a preferred embodiment of the present invention.

An apparatus 10 comprising a preferred embodiment of the present invention is shown in FIG. 1. The apparatus comprises a microwave resonator 12 and a pair of external temperature compensators 14. Screws 20 couple the external temperature compensators 14 to the resonator 12. The microwave resonator 12 comprises an upper structure 24 and a lower structure 26. The upper structure 24 and the lower structure 26 are generally rectangular, block-shaped structures.

Figure 2:
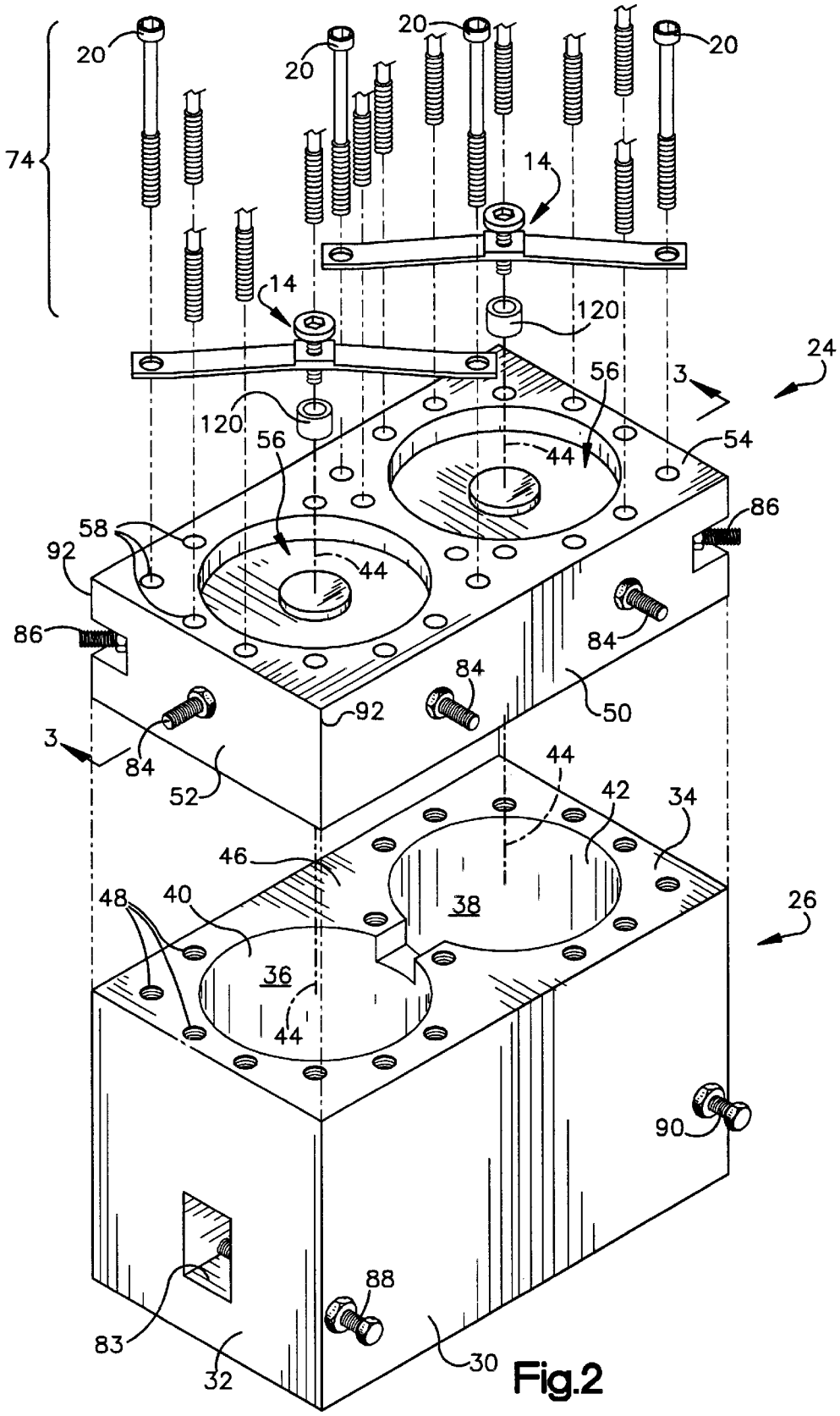
FIG. 2 is an exploded view of the apparatus shown in FIG. 1.

The lower structure 26 has a pair of side walls 30 and a pair of end walls 32. A mating surface 34 (FIG. 2) of the lower structure 26 is a planar surface perpendicular to the side walls 30 and end walls 32. A pair of cylindrical recesses 36 and 38 extend into the lower structure 26 and define a pair of cylindrical inner wall surfaces 40 and 42. The first recess 36 is an input recess. The second recess 38 is an output recess. Each recess 36 and 38 is centered on one of a pair of parallel, central axes 44. The central axes 44 are perpendicular to the mating surface 34. A center wall 46 separates the cylindrical inner wall surfaces 40 and 42 of the input recess 36 and the output recess 38. A central iris 47 extends into the center wall 46 and electromagnetically couples the input recess 36 to the output recess 38. An array of internally threaded apertures 48 surround the recesses 36 and 38.

Figure 3:
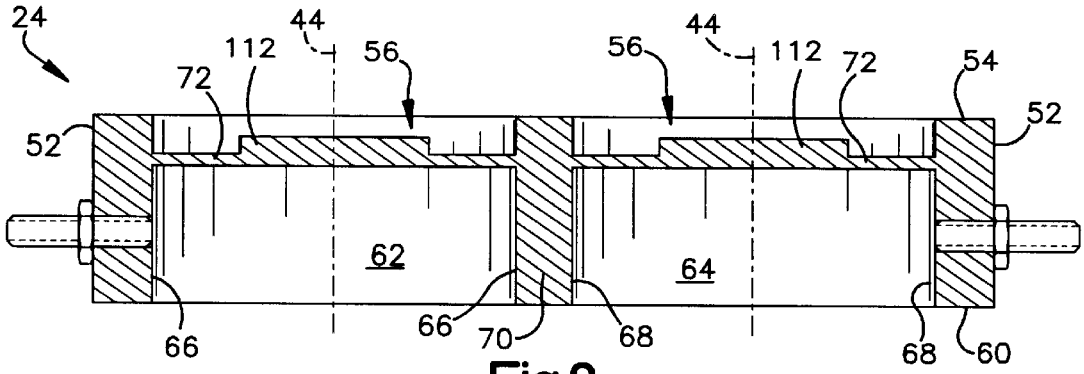
FIG. 3 is a cross sectional view of a part shown in FIG. 2.

The upper structure 24 has a pair of side walls 50 and a pair of end walls 52. A top surface 54 is a planar surface perpendicular to the side walls 50 and end walls 52. A pair of cylindrical, shallow recesses 56 extend into the upper structure 24 along the central axes 44. Within the shallow recesses 56, a raised center portion 112 is also centered on the axis 44. An array of apertures 58 extend circumferentially around each shallow recess 42 and fully through the upper structure 24. A mating surface 60 (FIG. 3) is a planar bottom surface perpendicular to both the side walls 50 and end walls 52.

The upper structure 24 has a pair of cylindrical recesses 62 and 64 that extend into the upper structure 24 from the mating surface 60. The recesses 62 and 64 are defined by a pair of cylindrical inner wall surfaces 66 and 68 centered on the central axes 44. A center wall 70 separates the inner wall surfaces 66 and 68. The recesses 62 and 64 are machined to a depth short of reaching the surface recesses 56 on the top surface 54. Accordingly, a thin circular wall 72 separates the surface recesses 56 on the top surface 54 from the recesses 58 extending from the mating surface 60.

The resonator 12 is assembled by moving the two mating surfaces 34 and 60 into abutment with each other. The upper structure 24 is fastened to the lower structure 26 by a set of screws 74. These screws 74 are received through the apertures 58 in the upper structure 24 and are screwed into the threaded apertures 48 on the mating surface 34 of the lower structure 26. The inner wall surfaces 66 and 68 of the upper structure 24 are then aligned with the inner wall surfaces 40 and 42 of the lower structure 26. The recesses 62 and 64 in the upper structure 24 are thus aligned with the recesses 36 and 38 in the lower structure 26.

Figure 4:
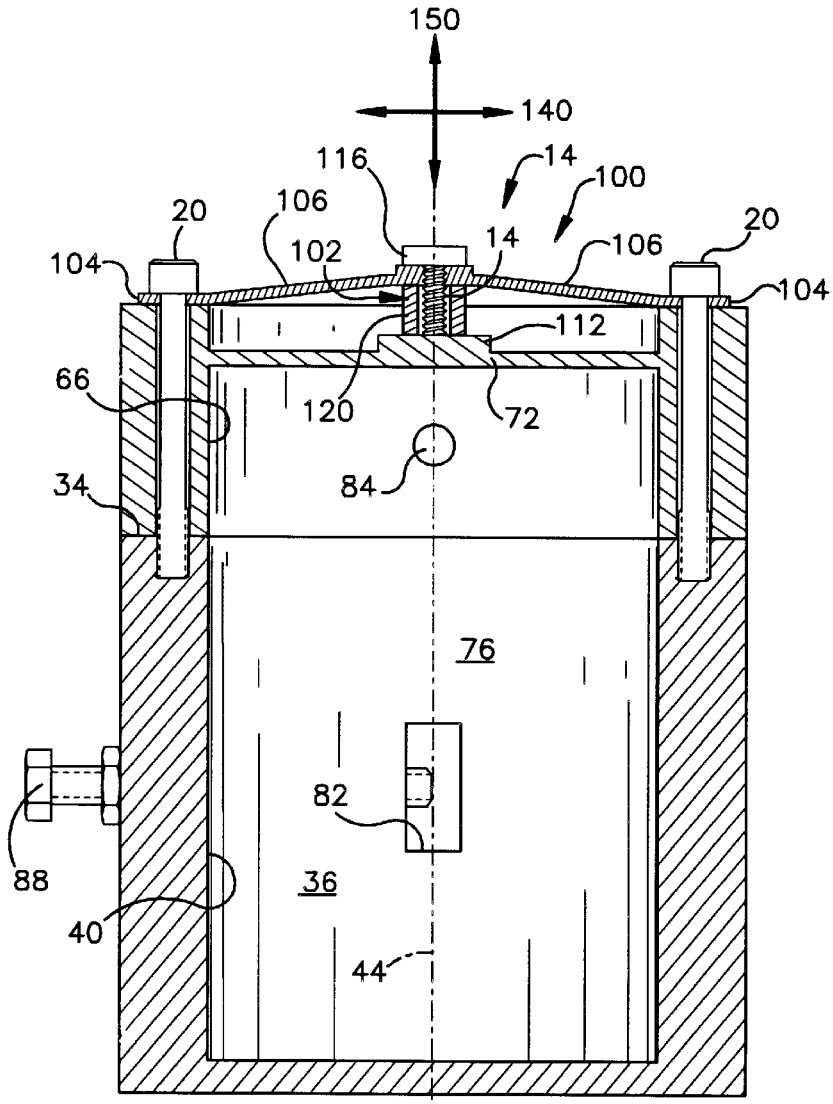
FIG. 4 is a view taken on line 4—4 of FIG. 1.

The aligned recesses 36, 62, 38, and 64 define a pair of cavities 76, one of which is shown in FIG. 4. The cavity 76 is partially defined by the input recess 36 and thus functions as an input cavity. The other cavity (not shown) is partially defined by the output recess 38 and thus functions as an output cavity. The mating surfaces 34 and 60 tightly engage one another to ensure electrical continuity across the inner wall surfaces 36 and 62 as well as the inner wall surfaces 38 and 64. While the cross section of the cavity 76 is circular, other cross sections, such as a rectangular cross section, can produce the same desired results.

An input iris 82 couples the input cavity 76 to an input device through an input wave guide 83. The input waveguide 83 receives an input device so that the input signal can be passed through the input iris 82 and into the input cavity 76. The input iris 82 is a slot that extends from the inner cylindrical wall 40 of the input cavity 76 to the input waveguide 83. A similar output iris and output waveguide (not shown) extend through the opposite end wall 32 for a similar purpose of coupling an output device to the output cavity.

A number of adjusting screws are used within the resonator 12 including: tuning screws 84, coupling screws 86, and input/output screws 88 and 90. The tuning screws 84 are perpendicular to and extending through the side walls 30 and end walls 32. Each cavity 76 receives a pair of tuning screws 84 orthogonally located with respect to each other along the inner wall surfaces 66 and 68. Each cavity 76 also receives a coupling screw 86 diagonally oriented relative to the tuning screws 84 at a corner 92 of the upper structure 24. The input screw 88 extends from the side wall 30 into the input iris 82. The output screw 90 extends from the side wall 30 into the output iris (not shown).

Figure 5:
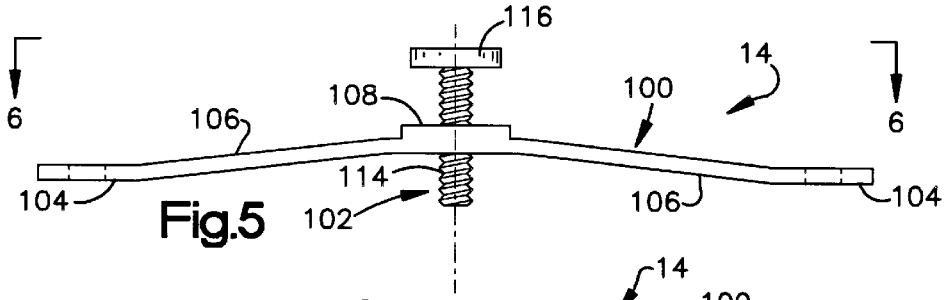
FIG. 5 is a side view of a compensator shown in FIG. 2.
Figure 6:
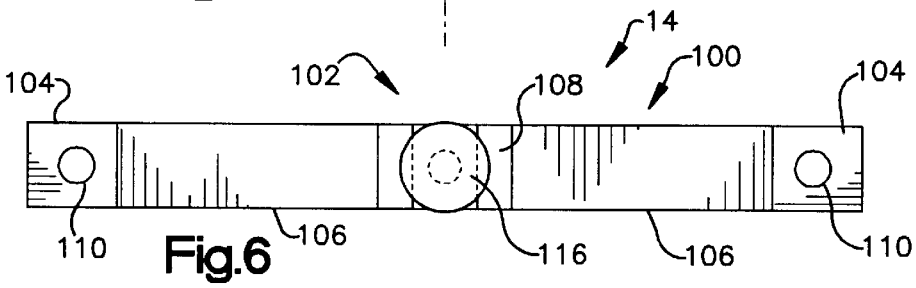
FIG. 6 is a view taken on line 6—6 of FIG. 5.

The external temperature compensators 14 are similar in structure. The compensators 14 have a bent strap 100, a thumb screw 102 (FIGS. 5 and 6) and a spacer 120. The bent strap 100 has a pair of horizontal flanges 104. A diagonal projection 106 of the bent strap 100 projects outward from each of the horizontal flanges 104. A center member 108 connects the ends of the diagonal projections 106. Each of the flanges 104 and the center member 108 have an aperture 1 10.

The thumb screw 102 has a threaded shaft 114 and a screw head 116. The threaded shaft 114 is advanced through the aperture 110 in the center member 108, the spacer 120, and rotatably received in the center portion 112. The thumb screw 102 is moved to a position where the spacer 120 is tightly fit between the center section 112 and the bent strap 100 as shown in FIG. 4.

In operation, the microwave resonator 12 passes an electromagnetic signal from an input device to an output device. The resonator 12 receives the signal through the input iris 82 and resonates an input mode in the input cavity 76. Filtering properties of the resonator 12 are enhanced by adding more modes to the resonator 12. This is accomplished by using coupling screws 86 to create orthogonal modes in the input cavity 76 and the output cavity. The coupling screw 86 in the input cavity 76 couples the input mode (the first mode) to a second mode perpendicular to the first mode within the input cavity 76. The output cavity is coupled to the input cavity 76 through the iris 47. The iris 47 couples the electromagnetic wave in the input cavity 76 to a third mode in the output cavity. The coupling screw 86 in the output cavity couples the third mode to a fourth mode perpendicular to the third mode. The filtered output signal passes through the output iris to be used by an output device.

The resonator 12 is tuned to a center frequency and a bandwidth by adjusting the physical characteristics of the resonator 12. Each tuning screw 84 tunes one of the four modes. The size and shape of the resonator 12 also effect the center frequency and bandwidth of the resonator 12. Any change in size of the cavities will shift the center frequency and change the range of the bandwidth of the resonator 12. Therefore, in accordance with the invention, the apparatus 10 is configured to counteract any change in size due to thermal expansion in order to maintain a constant frequency range and constant center frequency. This is accomplished using the external temperature compensators 14.

The external temperature compensators 14 are made of a material with a thermal expansion rate different than the thermal expansion rate of the resonator 12. The different thermal expansion rates and the configuration of the external compensator 14 minimize any changes in volume of the cavities 74 and 76 due to thermal expansion. If the resonator 12 is placed in a negative temperature gradient, the compensators 14 will act to increase the volume of the contracting cavities 76. If the resonator 12 is placed in a positive temperature gradient, the compensators 14 will act to reduce the volume of the expanding cavities 76.

Specifically, when the resonator 12 and compensator 14 are placed in either a positive or negative thermal gradient, the strap 100 and thumb screw 102 of each compensator 14 move along a horizontal axis 140 and a vertical axis 150 (FIG. 4). For example, when placed in a negative temperature gradient, both the compensator 14 and the resonator 12 contract in all directions. The compensator 14, having a lesser thermal coefficient of thermal expansion, does not contract as fast as the resonator 12 and is therefore deflected with respect to the resonator 12. As the resonator 12 shrinks, the horizontal flanges 104 of the compensator 14 are pushed towards one another along the horizontal axis 140. The horizontal flanges 102 push the diagonal projections 106 inward along the horizontal axis 140 and upward along the vertical axis 150. The center member 108 of the compensator 14 pushes the screw head 116 upward along the vertical axis 150 by the movement of the diagonal projections 106. The threaded shaft 114 and the center portion 112 are pulled upward. This relieves some of the stress placed on the thin wall 72 by the center portion 112 and the thin wall 72 deflects upward. In this manner. the volume inside the cavity 74 remains the same since the change in volume due to thermal effects is offset by the action of the compensator 14.

In a positive temperature gradient, both the compensator 14 and resonator 12 expand in all directions. The compensator 14 expands at a lesser rate than the resonator 12 because of its lower coefficient of thermal expansion. As the resonator 12 expands, the horizontal flanges 104 of the compensator 14 are pulled apart from one another along the horizontal axis 140. The horizontal flanges 104 pull the diagonal projections 106 outward along the horizontal axis 140 and downward along the vertical axis 150. The center member 108 of the compensator 14 is pulled downward along the vertical axis 150 by the movement of the diagonal projections 106. The center member 108 pushes the spacer 120 downward into the center portion 112. This increases the stress on the thin wall 72 and deflects the thin wall 72 downward. As described above with respect to the negative temperature gradient, the volume inside the cavity 74 remains the same since the change in volume due to thermal effects is offset by the action of the compensator 14.

The external temperature compensator 14 operates within a range of temperatures. The vertical depth to which the center portion 112 of the compensator 14 is set is determined by the maximum temperature within the desired temperature range. Based on the operational temperature range, a total displacement of the compensator 14 can be calculated. The maximum operating temperature is used to determine the vertical offset necessary to meet the thermal requirement. As the resonator 12 and compensator 14 are heated, the compensator 14 begins to load the thin wall 72 and deflect the central portion 112 of the thin wall 72. At the maximum temperature, the thin wall 72 is loaded maximally and the central portion is fully deflected.

By isolating the mating surfaces 34 and 60 relatively far from the thin wall 72, electrical continuity along the inner wall surfaces 40 and 62 and the inner wall surfaces 42 and 64 is maintained when the thin wall 72 is maximally deflected. The lesser thickness of the thin wall 72 relative to the greater thickness of the side and end walls 50 and 52, and thus the relatively increased stiffness of the side and end walls 50 and 52, isolates the mating surfaces 34 and 60 from the deflection of the thin wall 72.

The temperature compensation can also include another pair of compensators 14 placed on the side opposite the first pair of compensators 14. Such a configuration increases the amount of compensation that is attainable. This added compensation could be implemented if the thin wall 72 is subjected to stress loads from the compensator 14 that are not tolerable for the configuration. Such a configuration would require each compensator 14 to deflect half the distance of the one-sided compensation technique.

The invention has been described with reference to a preferred embodiment. Those skilled in the art will perceive improvements, changes, and modifications. Such improvements, changes, and modifications are intended to be within the scope of the claims.

What is claimed is:

1. Apparatus comprising:

a microwave resonator having a cavity with a specified volume, said cavity being formed of a first material having a first coefficient of thermal expansion; and an external temperature compensating structure, said external temperature compensating structure being formed of a second material having a second coefficient of thermal expansion, said second coefficient of thermal expansion being lower than said first coefficient of thermal expansion;

the temperature compensating structure being configured and oriented relative to a wall of the microwave resonator such that when the microwave resonator and the temperature compensating structure undergo thermally induced deflection, the temperature compensating structure applies a restoring force to the wall of the microwave resonator which deflects the wall oppositely relative. to the thermally induced deflection so as to maintain the specified volume of the cavity.

2. Apparatus as defined in claim 1, wherein the microwave resonator and the temperature compensating structure are coupled together such that the resonator, upon undergoing the thermally induced deflection, urges the temperature compensating structure to deflect the wall oppositely relative to the thermally induced deflection.

3. Apparatus as defined in claim 1, wherein the temperature compensating structure comprises a rod and a strap, the strap having opposite end portions fixed to the resonator and a middle portion spaced from the resonator such that when the resonator undergoes the thermally induced deflection the opposite end portions of the strap are moved in a radial direction of the resonator and draw the middle section of the strap in an axial direction of the resonator, the rod being coupled to the middle section of the strap so as to move against the wall of the resonator in the axial direction when the resonator undergoes the thermally induced deflection.

4. Apparatus as defined in claim 3, wherein the middle section of the strap has an aperture with an internal screw thread and the rod has an external screw thread engaged with the internal screw thread so as to be advanced or retracted relative to the wall upon being rotated relative to the aperture.

5. A microwave resonator comprising:

a resonator body structure having a cavity with a volume, said resonator body structure being formed of a first material having a first coefficient of thermal expansion; and a temperature compensating structure comprising a bar-shaped member is coupled to the exterior of the resonator body structure, said temperature compensating structure being formed of a second material that is different from the first material, said second material having a second coefficient of thermal expansion, said second coefficient of thermal expansion being lower than said first coefficient of thermal expansion, wherein the temperature compensating structure is responsive to changes in temperature and is configured to maintain a constant volume of the cavity of the resonator body structure during said changes in temperature.

6. The microwave resonator of claim 5, wherein the bar-shaped member is coupled to the exterior of the resonator body structure by a plurality of screws.

7. The microwave resonator of claim 6, wherein the bar-shaped member has a substantially V-shaped cross-section and includes three screw holes at the ends and center thereof, and the plurality of screws comprise three screws which extend through the screw holes to couple the bar-shaped member to the resonator body structure.

8. The microwave resonator of claim 7, wherein the V-shaped bar-shaped member is positioned on the exterior of the resonator body structure such that the V-shape is inverted.

9. A microwave resonator comprising:

a first body structure having a first end with a thinned end wall and a second end defining at least one recess extending inwardly from the second end, said recess defining an inner wall surface positioned around a central axis, with the second end defining a mating surface around the recess;

a second body structure having an end wall at a first end and defining at least one recess extending inwardly from a second end, said recess having an inner wall surface positioned around a central axis, with the second end defining a mating surface around the recess, wherein the mating surface of the first body structure abuts the mating surface of the second body structure such that the central axes of the respective recesses align and the recesses together define at least one cavity having a volume, with the inner wall surfaces of the first body structure and the inner wall surface of the second body structure being configured to maintain an electrical continuity in the cavity; and a temperature compensating structure coupled to the first body structure for maintaining a constant volume of the cavity in response to a change in temperature.

10. The microwave resonator of claim 9, wherein the first and second ends of the first body structure are positioned opposite one another and the first and second ends of the second body structure are positioned opposite one another.

11. The microwave resonator of claim 9, wherein the temperature compensating structure is coupled to the thinned end wall of the first body structure and the thinned end wall is configured to deflect when so directed by the temperature compensating structure in response to a change in temperature.

12. The microwave resonator of claim 9, wherein the first body structure is affixed to the second body structure by fasteners positioned around the perimeter of the at least one cavity.

13. The microwave resonator of claim 9, wherein the at least one cavity is cylindrical.

14. The microwave resonator of claim 9, wherein the at least one recess in the first body structure comprises a pair of recesses that are separated from each other by a center wall, and the at least one recess of the second body structure comprises a pair of recesses that are separated from each other by a center wall, said recesses together defining a pair of cavities, with an iris extending between the cavities such that the pair of cavities communicate with each other through the iris.

15. The microwave resonator of claim 14, wherein the iris is a hole extending through the center wall of the second body structure between the cavities.

16. The microwave resonator of claim 15, wherein the iris is a channel extending through the center wall of the second body structure between the cavities at the mating surface of the second body structure.

17. The microwave resonator of claim 9, wherein the temperature compensating structure comprises at least one bar-shaped member coupled to the exterior of the first body structure at the thinned end wall.

18. The microwave resonator of claim 17, wherein the at least one bar-shaped member is coupled to the exterior of the first body structure adjacent the at least one recess, such that a bar-shaped member is coupled to each recess.

19. The microwave resonator of claim 18, further comprising at least three screws, wherein the at least one bar-shaped member has a substantially V-shaped cross-section and includes three screw holes at the ends and center thereof, and the at least one bar-shaped member is coupled to the first body structure by the plurality of screws.

20. The microwave resonator of claim 19, further comprising a spacer positioned between the center of the V-shaped bar-member and the end wall of the first body structure.

* * * * *

UNITED STATES PATENT AND TRADEMARK OFFICE

CERTIFICATE OF CORRECTION

PATENT NO. : 6,535,087 B1
DATED : March 18, 2003
INVENTOR(S) : Fitzpatrick et al.

It is certified that error appears in the above-identified patent and that said Letters Patent is hereby corrected as shown below:

Column 5,
Line 60, change "relative." to -- relative --

Signed and Sealed this

Seventeenth Day of June, 2003

JAMES E. ROGAN
*Director of the United States Patent and Trademark Office*